US011565430B1

(12) United States Patent
Davidson

(10) Patent No.: US 11,565,430 B1
(45) Date of Patent: Jan. 31, 2023

(54) FILET KNIFE

(71) Applicant: Toadfish LLC, Charleston, SC (US)

(72) Inventor: Casey Davidson, Charleston, SC (US)

(73) Assignee: Toadfish LLC, Charleston, SC (US)

( * ) Notice: Subject to any disclaimer, the term of this patent is extended or adjusted under 35 U.S.C. 154(b) by 0 days.

(21) Appl. No.: 17/385,449

(22) Filed: Jul. 26, 2021

Related U.S. Application Data

(60) Provisional application No. 63/056,784, filed on Jul. 27, 2020.

(51) Int. Cl.
*B26B 1/04* (2006.01)
*B26B 1/10* (2006.01)

(52) U.S. Cl.
CPC ..... *B26B 1/046* (2013.01); *B26B 1/10* (2013.01)

(58) Field of Classification Search
CPC ..... B26B 1/04; B26B 1/046; B26B 1/042; B26B 1/02; B26B 1/10; B26B 11/00; B26B 29/025; A01K 69/00; A41D 2600/106
See application file for complete search history.

(56) References Cited

U.S. PATENT DOCUMENTS 6,223,372 B1 * 5/2001 Barber ..... B25F 1/00 7/118
6,594,906 B1 * 7/2003 Sakai ..... B26B 3/06 30/155
6,694,620 B2 * 2/2004 Kanzawa ..... B23D 51/03 30/504
D538,138 S * 3/2007 Knight ..... D8/356
7,676,931 B2 * 3/2010 Knight ..... B26B 1/044 30/158
9,393,682 B2 * 7/2016 Green ..... B26B 1/04
D852,005 S 6/2019 Davidson
2004/0231163 A1 * 11/2004 Sakai ..... B26B 11/00 30/146
2007/0068001 A1 * 3/2007 Steigerwalt ..... B23D 51/03 30/161
2009/0265939 A1 * 10/2009 Chu ..... B26B 1/042 30/159
2014/0173910 A1 * 6/2014 Green ..... B25F 1/04 81/490

OTHER PUBLICATIONS

U.S. Appl. No. 63/056,784, filed Jul. 27, 2020 titled Filet Knife.

* cited by examiner

*Primary Examiner* — Jennifer S Matthews
(74) *Attorney, Agent, or Firm* — Dinsmore & Shohl LLP

(57) ABSTRACT

Present embodiments related to a filet knife. More specifically, but without limitation, the present embodiments relate to a folding filet knife which is moveable between an extended position and a folded position. The blade has a length that is greater than the length of the handle. The filet knife has a handle with a second structure, for example a clip that can receive a portion of the blade that extends beyond the handle when the blade is in the folded position.

17 Claims, 6 Drawing Sheets

FILET KNIFE

CLAIM TO PRIORITY

This non-provisional patent application claims priority to and benefit of, under 35 U.S.C. §119(e), U.S. Provisional Patent Application Ser. No. 63/056,784, filed Jul. 27, 2020 and titled "Filet Knife", all of which is incorporated by reference herein.

BACKGROUND

1. Field of the Invention

Present embodiments related to a filet knife. More specifically, but without limitation, the present embodiments relate to a folding filet knife.

2. Description of the Related Art

Filet knives are used to clean fish and other game, and typically have a larger ration of blade length to width (height) than other types of blades. Due to this blade length typical of filet knives, the knives are generally not found in the folding type.

Due to the desire to use these types of knives to clean fish, one often finds these knives laying around a boat, with the blade exposed. While these knives may often come with sheathes, they are frequently lost over time resulting in the knife blade being exposed. This can lead a dangerous situation and may result in injury to the people on the fishing trip or at a camp site.

The information included in this Background section of the specification, including any references cited herein and any description or discussion thereof, is included for technical reference purposes only and is not to be regarded subject matter by which the scope of the invention is to be bound.

SUMMARY

The present application discloses one or more of the features recited in the appended claims and/or the following features which alone or in any combination, may comprise patentable subject matter.

Present embodiments relate to a folding filet knife. The present embodiments provide a filet knife with a blade that extends beyond the end of the handle when in a folded position. The portion of the blade that extends beyond the handle is positioned within a structure connected to the handle so that the sharpened blade edge is not exposed and cannot cut someone inadvertently. Further, the folding ability of the filet knife makes the knife easy to pack and carry during camping and fishing excursions.

According to some embodiments, a folding filet knife may comprise a handle having a first end and a second end, a blade pivotally connected to the handle by a pivot near one of the first end or the second end. The blade may be configured to move between an extend position and a folded position. The blade may have a blade length that extends beyond the other of the first end or the second end of the handle. A clip disposed at the other of the first end or the second end, the clip having a fixed structure and a movable arm that moves between an engaged position with the fixed structure and a disengaged position from the fixed structure. The fixed structure of the clip may have a groove to receive a portion of the blade.

According to some optional embodiments, the following features may be used alone with the folding filet knife or in combination with other features and the folding filet knife. The clip may be a carabiner. The handle may have a handle length. The blade length may be greater than the handle length. The handle may further comprise a frame. The pivot may join the blade and the frame. The handle may have a first side and a second side. The first side and the second side may have grip knurling. The blade may have a sharpened edge. The sharpened edge may be disposed in the groove. The blade may have a length to width ratio of at least 8:1.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and drawings, included herewith. A more extensive presentation of features, details, utilities, and advantages of the present invention is provided in the following written description of various embodiments of the invention, illustrated in the accompanying drawings, and defined in the appended claims.

BRIEF DESCRIPTION OF THE DRAWINGS

In order that the embodiments may be better understood, embodiments of a filet knife will now be described by way of examples. These embodiments are not to limit the scope of the claims as other embodiments of a filet knife will become apparent to one having ordinary skill in the art upon reading the instant description. Non-limiting examples of the present embodiments are shown in figures wherein:

DETAILED DESCRIPTION

Figure 1:
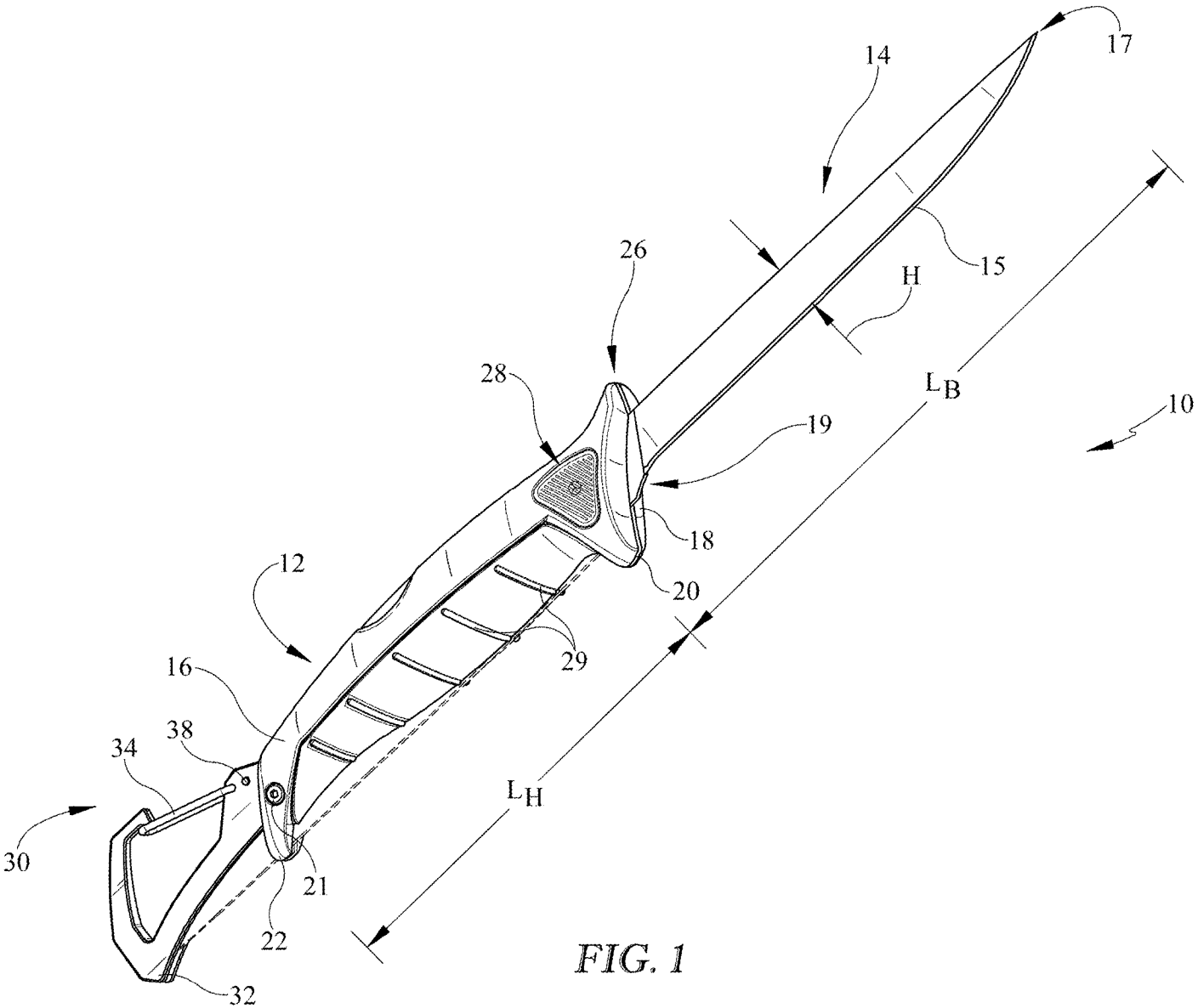
FIG. 1 is a perspective view of a folding filet knife is an extended position.

It is to be understood that a filet knife is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Reference throughout this specification to "one embodiment", "some embodiments" or "an embodiment" means that a particular feature, structure or characteristic described in connection with the embodiment is included in at least one embodiment of the present invention. Thus, appearances of the phrases "in one embodiment", "in some embodiments" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

It would be desirable to provide a filet knife which is foldable and more readily carried for camping, fishing, and other outdoor excursions. It would also be desirable to provide a filet knife with a long blade wherein the sharpened edge may be covered without the need for a removable sheath that is prone to be misplaced.

Referring now to FIGS. 1-6, a folding filet knife is provided wherein the blade of the knife is longer than the handle and when in a folded configuration, a portion of the blade extends beyond an end of the handle, opposite the pivot end. Rather than remaining exposed, the sharpened blade edge is disposed within a second structure, for example a clip that extends from the handle. As a result, the filet knife may be folded while still providing a safe configuration of the knife blade, and without leaving the blade exposed to possibly cut someone.

Referring now to FIG. 1, a folding filet knife 10 is shown in perspective view. The filet knife 10 is shown in an extended position and may be moved to a folded position (represented in broken line). The filet knife 10 includes a handle 12 and blade 14. The handle 12 may be gripped and when the blade 14 is extended, the knife blade 14 may be used to filet fish or other game.

Figure 5:
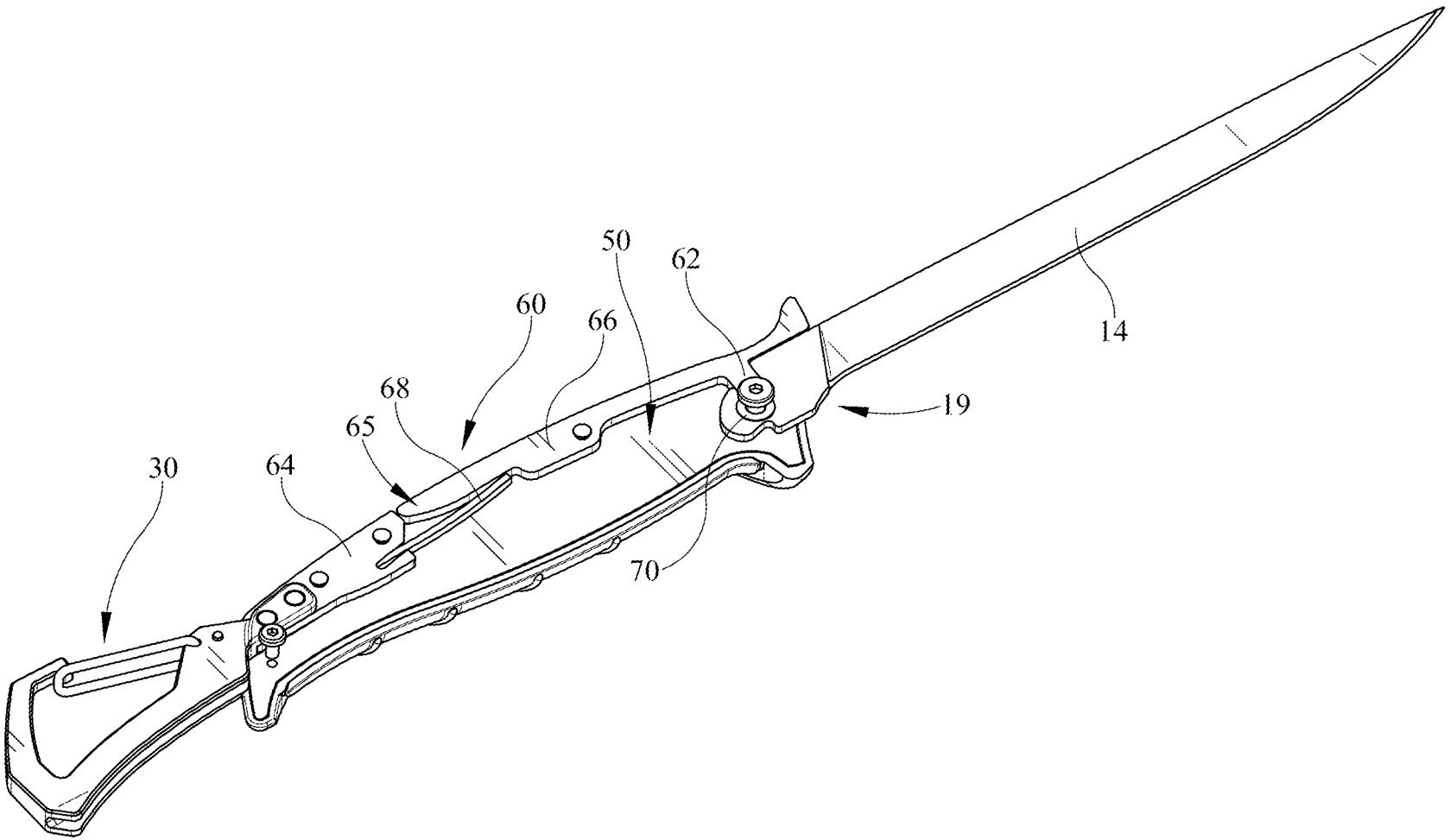
FIG. 5 is a perspective view of the folding filet knife with the handle sides removed and in the folded position; and, FIG. 6 is a perspective view of the folding filet knife with the handle sides removed and in the extended position.

The handle 12 may be formed of first side 16 and a second side 18. The handle 12 may have at least one fastener 21 that joins the first and second sides 16, 18 on either side of a frame 50 (FIG. 5). The handle 12 may have a length $L_H$ which represents a linear length from a first end 20 to a second end 22 of the handle 12 alone. The terms first and second, as modifying the term end, should not be considered limiting as they are merely descriptive. Accordingly, either end of the handle 12 may be the first end 20 or the second end 22. Further, in the instant embodiment, and merely for description, the second end 22 is the pitting end of the folding filet knife 10 when folded, and the handle end.

The handle 12 may further comprise various features that help with control and force application during cutting. For example, as shown at the second end 22, the handle 12 may include a flare 26 which user's fingers may engage to apply force during cutting. Adjacent to the flare 26 may be a textured finish 28 to engage a user's thumb or index finger. Along the bottom of the handle 12 may be finger grips 29 by which the user's fingers may obtain purchase when gripping the handle 12. The finger grips 29, the textured finish 28, and the flare 26 all may be varied to define grip and control features. The depicted features are therefore not limiting.

Extending from near the second end 22, the blade 14 is shown. The blade has a blade length $L_B$ which is greater than the handle length $L_H$. The blade 14 has a length $L_B$ to height H ratio which is greater than a typical folding pocket knife. In some embodiments, the blade length may be at least about five inches and in some embodiments may be up to about ten inches. In some embodiments, the height may be about ½ of an inch and may be up to about 1-½ inch. In some examples, the length $L_B$ to height H ratio may be 8:1 to about 12:1 so that the knife is generally recognized as a filet blade.

The blade 14 may also comprise a sharpened edge 15 that extends from a tip end 17 of the blade 14 to near the base end 19. The base end 19 extends into the handle 12 where it is captured between the first and second sides 16, 18 and pivots relative thereto.

At the opposite end of the handle 12, a clip 30 is located. The clip 30 includes a fixed structure 32 and a movable arm 34 which is pivotally connected to the fixed structure 32 by a pivot 38. The pivot 38 may be located at one end of the movable arm 34 and the opposite end be movable toward and away from the fixed structure 32. Within the outer periphery of the clip 30 is an open area wherein the clip 30 may be connected to some structure, for example a clothing belt loop or an opening of a cutting board. In this way, the folding filet knife 10 can be connected to something so as not to misplace it, or otherwise not lose it. The movable arm 34 may also be biased to move at the pivot 38 from a normally closed position depicted wherein the movable arm 34 engages the fixed structure 32, to an open position, wherein the movable arm 34 is spaced from the fixed structure 32. For example, a torsion spring or other biasing element may be used to retain the movable arm 34 in a desired, closed position.

The fixed structure 32 may be a generally L-shaped or J-shaped structure wherein the long leg of the L or J extends from the end 20 of handle 12. The length of the long leg in addition to the length of the handle 12 may be equal to, or longer than, the length of the blade 14. As shown by the broken line representing the folded blade 14, the blade 14 is partially housed within the fixed structure 32.

In some embodiments, the clip 30 may also be referred to as a carabiner. Other useful structures may be used as the second structure connected to, or extending from, the handle 12. For example, the clip 30 may be replaced with a bottle opener.

Figure 2:
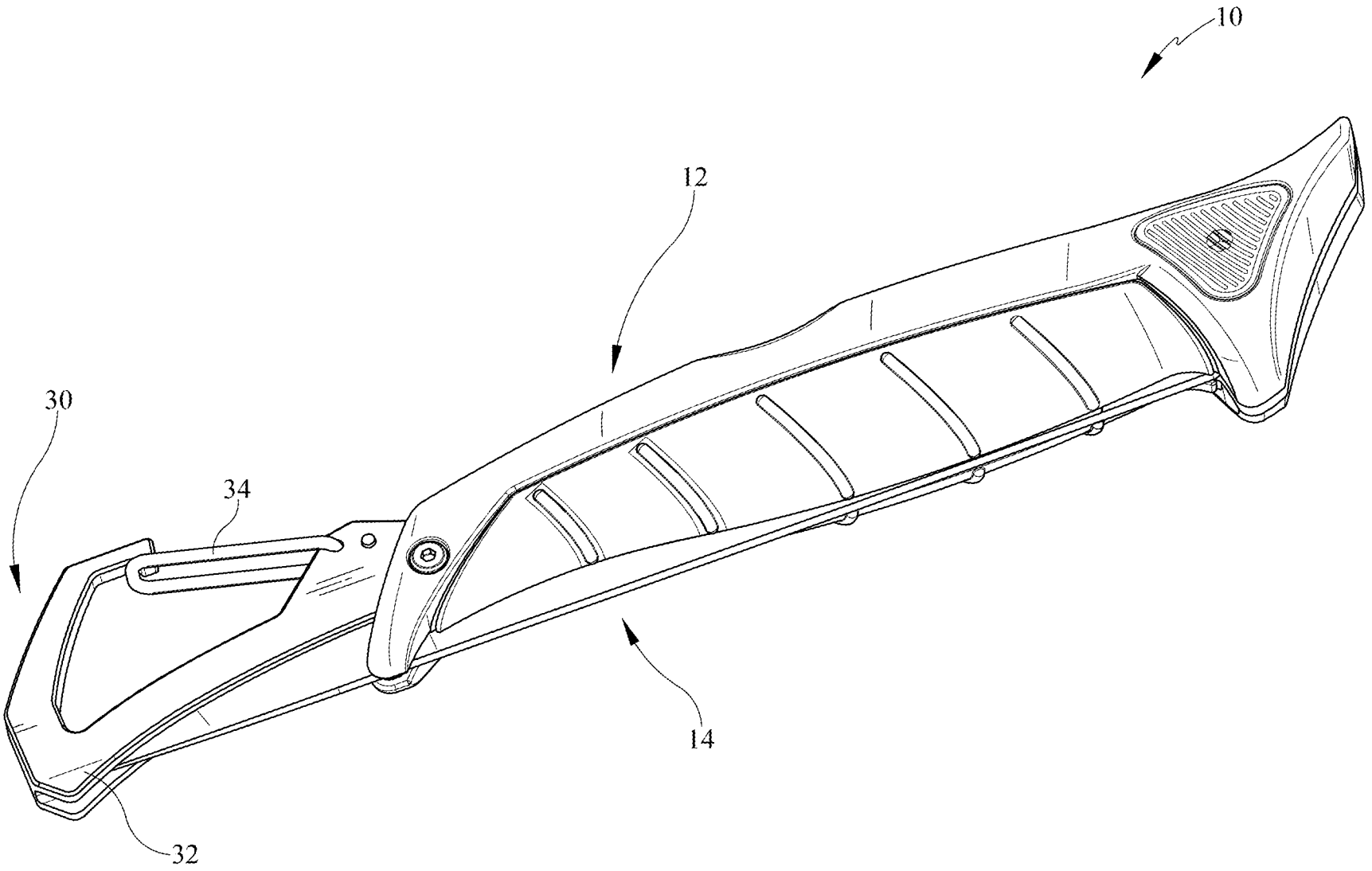
FIG. 2 is a perspective view of a folding filet knife in a folded position.

With reference now to FIG. 2, the folding filet knife 10 is shown in a folded position. The blade 14 has a length that is greater than that of the handle 12 but is equal to or less than the total linear length of the handle 12 and the fixed structure 32 of the clip 30. Accordingly, when in the folded configuration, the blade 14 extends beyond the handle 12 but may be at least partially housed within the clip 30. Specifically, the sharpened edge 15 of the blade 14 may be positioned in the clip 30 in order to hide the sharpened edge 15 from unintended injury.

Figure 3:
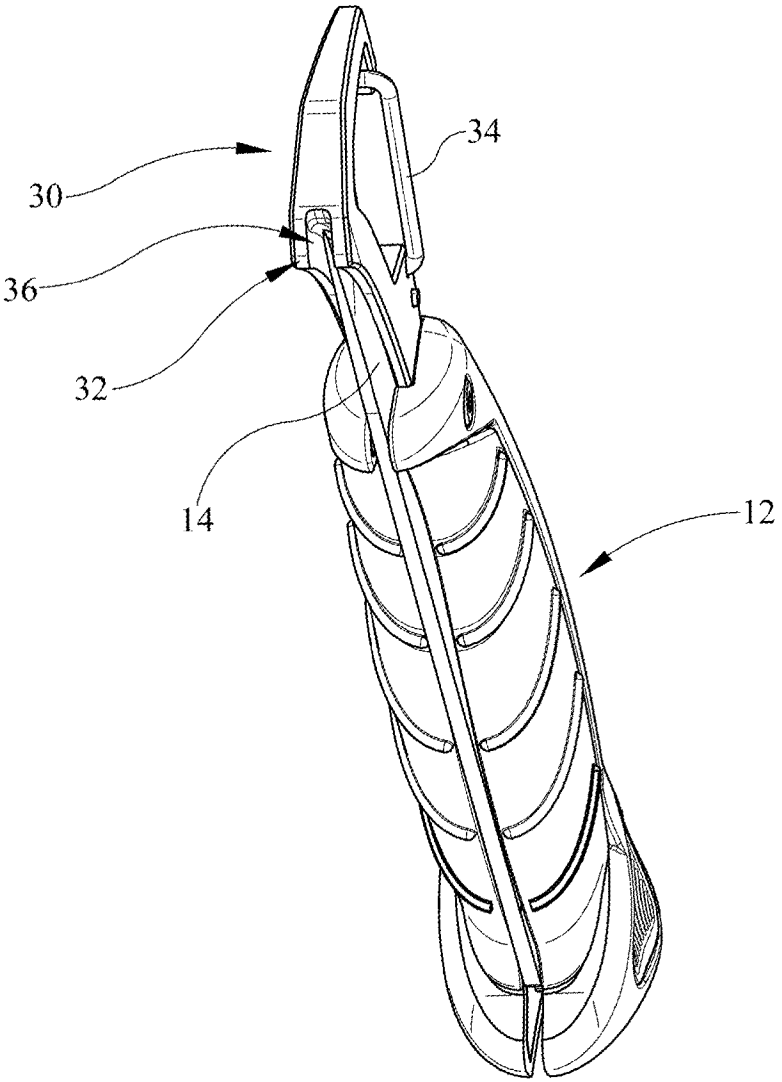
FIG. 3 is a perspective end view showing the edge of the blade being sheathed by a clip connected to the handle.

With reference to FIG. 3, a perspective view of an end of the folding filet knife 10 is shown. The view shows that the fixed structure 32 of the clip 30 may comprise a groove 36 along the side in which the blade 14 is positioned. The groove 36 may be sized to be wide enough and deep enough to receive a desired portion of the blade 14. As a result, the sharpened edge 15 may be positioned within the groove 36. The size of the fixed structure 32 may vary but at least some portion of the blade 14 is positioned therein.

As shown in the example, the fixed structure 32 may have some curvature as it extends from the handle 12. The curvature may approximate the curvature of the blade 14 toward the tip end 17 of the blade 14.

Figure 4:
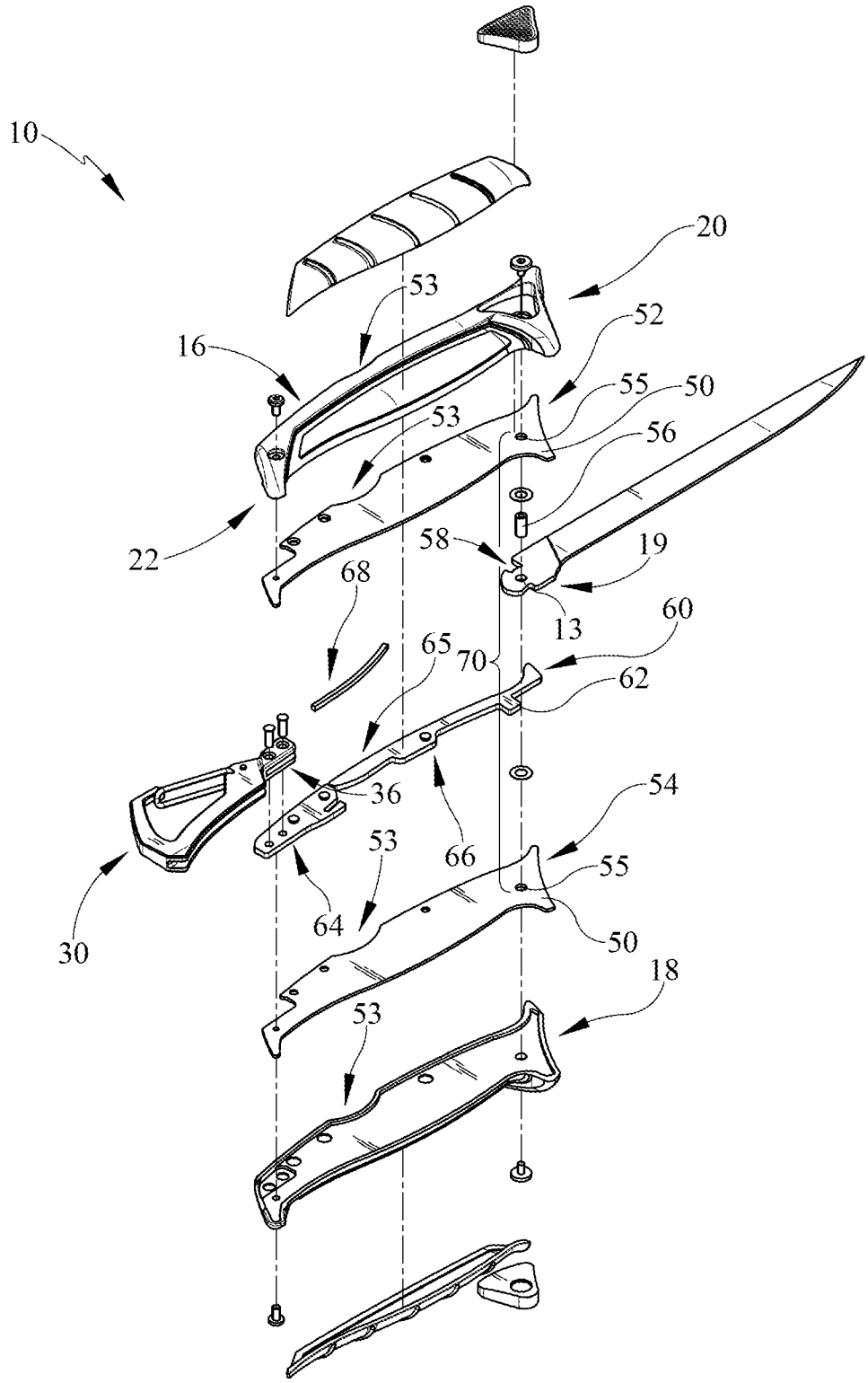
FIG. 4 is an exploded perspective view of the folding filet knife.

Referring now to FIG. 4, an exploded perspective view of the folding filet knife 10 is shown. The blade 14 is shown and the pivot 70 is provided at a base end 19 of the blade 14. The blade 14 is disposed between to plates 52, 54 that define a frame 50. The plates 52, 54 each comprise holes 55 through where an axle 56 is located. The axle 56 may be received by a hole 13 in the blade 14. The axle 56 and hole 13 arrangement defines one example of a pivot for the blade 14. The axle 56 may be formed on the frame 50 or may be formed separately and attached to the frame 50 or to the blade 14. Still further the axle 56 may be formed on the blade 14.

As shown in this view with the blade 14 exploded, the base end 19 also comprises a hook feature 58. Located adjacent to the blade 14 and between the plates 52, 54 is a lock strut 60 including an opposed strut lock 62. The lock strut 60 may be a two piece structure with one strut portion 64 connected to the clip 30 and the second portion 66 connected to the frame 50. The two portions 64, 66 are generally connected indirectly by an elastic member 68 that allows the second portion 66 to pivot about is connection to the frame 50 and relative to the first portion 64. The hook feature 58 and the strut lock 62 engage one another when the blade 14 is extended so that the two structures preclude inadvertent closure of the blade 14. More specifically the strut lock 62 may seat in the hook 58 when the blade 14 is extended. A notch 53 in the handle sides 16, 18 may expose an unlocking portion 65 of strut 60 which may be engaged by the user. The unlocking portion 65 may be depressed by a user to move the strut lock 62. When the strut lock 62 moves away from the hook feature 58 of the blade 14, the blade 14 may be pivoted from the extended position (FIG. 1) to the folded closed position (FIG. 2).

At an opposite end of the strut lock 62 is the clip 30. An end of the clip 30 may function as a connection structure with the strut 60 first portion 64. In some embodiments, the groove 36 may also receive the lock strut 60. In some embodiments a separate groove may be formed for the blade 14 and the second strut portion 66. The clip 30 may be fastened to the lock strut 60 or may be formed integrally on the lock strut 60, or in still other embodiments may be welded, adhered, or otherwise joined.

Outside of the frame 50 are the sides 16, 18. The sides 16, 18 may be joined by fasteners through the frame 50. The sides 16, 18 may be formed by metal, wood, plastic or other rigid structure capable of being handled by a user and able to withstand repeated force by a user and retain the assembly together. As previously described the sides 16, 18 may have various structures and features to aid in gripping the folding filet knife 10.

The sides 16, 18 may each be one piece or multi-piece structures. In some embodiments, the various grip and control features may be formed of a separate material and bonded or otherwise joined to the sides 16, 18. For example, the sides 16, 18 may be formed of a plastic or polymeric material, and the grip features 29 (FIG. 1) may be formed of a rubber or softer material that is bonded to the sides 16, 18. In the depicted embodiment, the gripping and control features are formed separately but such features may be molded or otherwise machined into the sides 16, 18.

Referring now to FIG. 5, an assembly perspective view of the folding filet knife 10, is provided with the sides 16, 18 removed from the frame 50. The blade 14 is shown in the extended position. The strut lock 62 is shown engaging the hook feature 58 (FIG. 6) of the blade 14. Further, from this view, one can see that the unlocking portion 65 of strut 60 may be depressed against the elastic member 68. The elastic member 68 is disposed between portions 64, 66 to bias portion 66 into the position shown. When depressed, the unlocking portion 65 of the strut 60 pivots and the strut lock 62 moves away from the base end 19 of the blade 14. When this occurs, the blade lock function is disengaged and the blade 14 may be rotated from the extended position toward the folded position.

Figure 6:
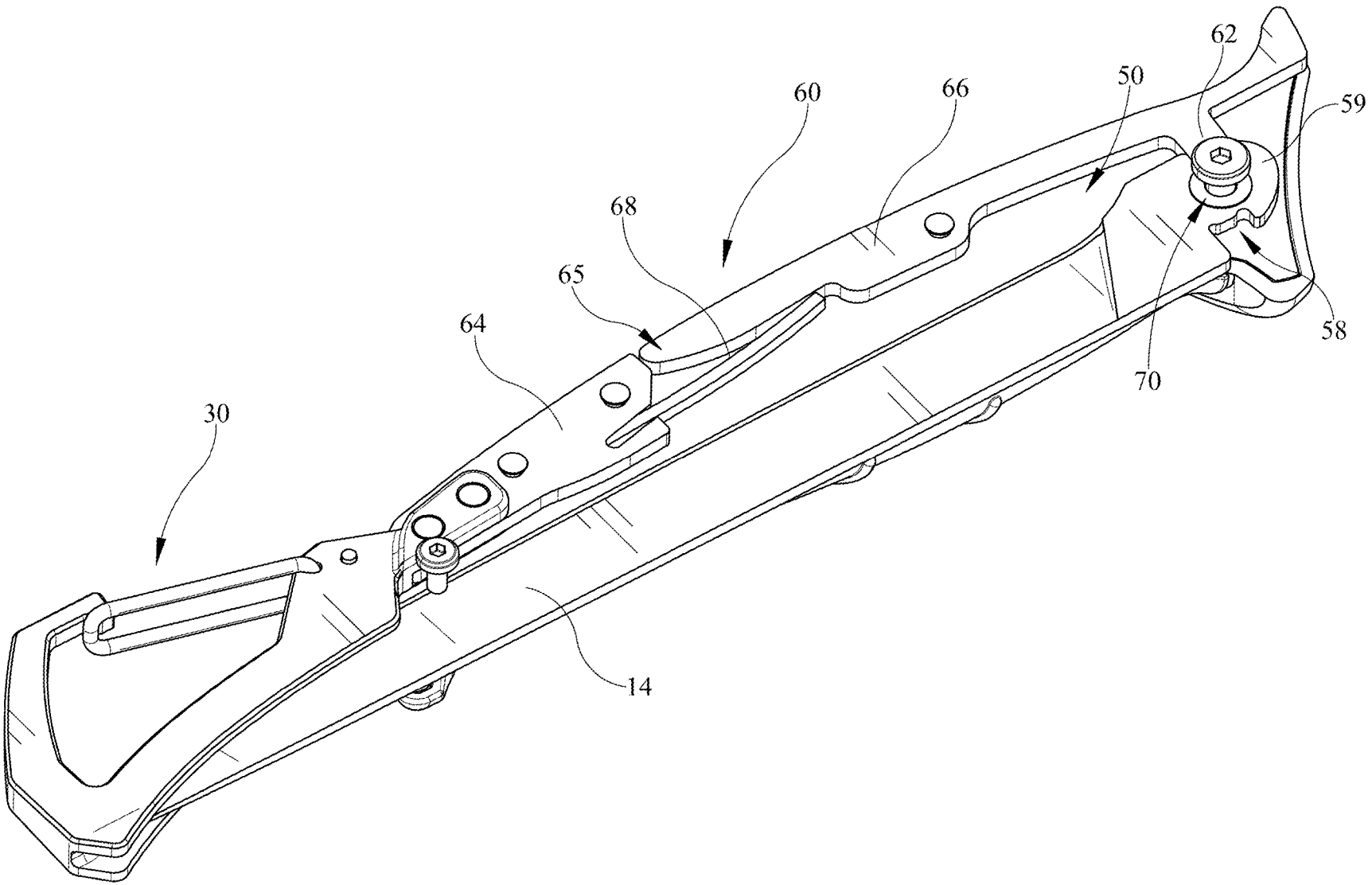

Referring now to FIG. 6, an assembly perspective view of the folding filet knife 10, is provided with the sides 16, 18 removed from the frame 50 and blade 14 in a folded, closed position. In this view, the hook feature 58 is shown rotated away from the strut lock 62. The strut lock 62 is shown engaging a cam surface 59 of the base end 19 of the blade 14.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

The foregoing description of methods and embodiments has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. A folding filet knife, comprising:

a handle having a first end and a second end;

a blade pivotally connected to the handle by a pivot near one of the first end or the second end, the blade is configured to move between an extend position and a folded position;

the blade having a blade length that extends beyond the other of the first end or the second end of the handle;

a clip disposed at the other of the first end or the second end, the clip having a fixed structure and a movable arm that moves between an engaged position with the fixed structure and a disengaged position from said fixed structure;

said fixed structure of said clip having a groove to receive a portion of said blade.

2. The folding filet knife of claim 1, said clip being a carabiner.

3. The folding filet knife of claim 1, said handle having a handle length.

4. The folding filet knife of claim 3, said blade length being greater than said handle length.

5. The folding filet knife of claim 1, said handle further comprising a frame.

6. The folding filet knife of claim 5, said pivot joining said blade and said frame.

7. The folding filet knife of claim 5, said handle having a first side and a second side.

8. The folding filet knife of claim 7, said first side and said second side having grip knurling.

9. The folding filet knife of claim 1, said blade having a sharpened edge.

10. The folding filet knife of claim 9, said sharpened edge being disposed in said groove.

11. The folding filet knife of claim 1, the blade having a length to width ratio of at least 8:1.

12. The folding filet knife of claim 1 further comprising a lock.

13. The folding filet knife of claim 12, said lock defined by a strut lock and a hook feature.

14. A folding filet knife, comprising:

a clip having a fixed structure and a movable arm pivotally connected to said fixed structure;

a handle, said clip connected to one end of said handle;

a blade pivotally connected to said handle, said handle and said blade pivotally connected near an opposite second end of said handle;

said blade having a length that is greater than a length of said handle; and, wherein a portion of a sharpened edge of said blade extending beyond said handle is disposed in a groove of said clip.

15. The folding filet knife of claim 14, said clip having said fixed structure and said movable arm that moves between an engaged position with the fixed structure and a disengaged position from said fixed structure.

16. The folding filet knife of claim 14, said groove disposed in said fixed structure of said clip.

17. The folding filet knife of claim 14, further comprising a lock.

* * * * *